US008801472B1

(12) United States Patent
Yen et al.

(10) Patent No.: US 8,801,472 B1
(45) Date of Patent: Aug. 12, 2014

(54) AUDIO PLUG STRUCTURE HAVING AN ELECTRONIC ELEMENT WITH ELECTRODES

(71) Applicant: Conary Enterprise Co., Ltd., Taipei (TW)

(72) Inventors: Hsien-Cheng Yen, Taipei (TW); Wen-Wei Lin, Taipei (TW)

(73) Assignee: Conary Enterprise Co., Ltd., Taipei (TW)

( * ) Notice: Subject to any disclaimer, the term of this patent is extended or adjusted under 35 U.S.C. 154(b) by 32 days.

(21) Appl. No.: 13/746,569

(22) Filed: Jan. 22, 2013

(51) Int. Cl.
*H01R 24/04* (2006.01)

(52) U.S. Cl.
USPC ..... 439/668

(58) Field of Classification Search
CPC ..... H01R 24/58; H01R 2303/00; H01R 2307/00; H01R 2305/00; H01R 2301/12; H01R 13/6658; H01R 23/025; H01R 31/065
See application file for complete search history.

(56) References Cited

U.S. PATENT DOCUMENTS

| | | | | |
|---|---|---|---|---|
| 6,341,871 | B1 * | 1/2002 | Angelopoulos | 362/23 |
| 7,086,748 | B1 * | 8/2006 | Elembaby | 362/88 |
| 7,601,032 | B2 * | 10/2009 | Labarca et al. | 439/668 |
| 7,912,501 | B2 * | 3/2011 | Johnson et al. | 455/556.1 |
| 7,922,542 | B1 * | 4/2011 | Shu et al. | 439/668 |
| 8,611,564 | B1 * | 12/2013 | Yen et al. | 381/124 |
| 8,696,391 | B2 * | 4/2014 | Ladouceur et al. | 439/668 |

* cited by examiner

*Primary Examiner* — Chandrika Prasad
(74) *Attorney, Agent, or Firm* — Rosenberg, Klein & Lee

(57) ABSTRACT

The invention relates to an audio plug structure improvement, particularly to the audio plug coinciding with the standard specification of a 2.5 mm, 3.5 mm or 6.5 mm audio plug. The audio plug uses the composite structure of the conductive portion and insulating portion and the design of angle rotation to obtain power or signal without affecting normal use of the speaker of the electronic product. The ON/OFF switch is formed as long as the audio plug is rotated at a predetermined angle. Moreover, a predetermined electronic element can be arranged at the internal or external of the audio plug and the power or signal is obtained by the audio jack for having other functions except for transmitting the audio signal.

6 Claims, 10 Drawing Sheets

| System | 1 | 2 | 3 | 4 |
|---|---|---|---|---|
| Non-stereo headset | Left(L) | GND | | Mic |
| Stereo headset | Left(L) | Right(R) | GND | Mic |
| Headphone | Left(L) | Right(R) | GND | |

AUDIO PLUG STRUCTURE HAVING AN ELECTRONIC ELEMENT WITH ELECTRODES

BACKGROUND OF THE INVENTION

1. Field of the Invention

The invention relates to an audio plug structure improvement, particularly to the audio plug obtaining power or signal from an audio jack without affecting normal use of a speaker of an electronic product.

2. Description of the Related Art

With the rapid development of computer and communications technology, electronic products have become increasingly popular; especially mobile phones have become one of the essential devices of modern people. At the same time, the industry continues to introduce new mobile phones with various functions for enhancing the convenience and practicality of mobile phones. For example, smart phones have become the market mainstream, and the all-inclusive applications won the love of consumers.

FIG. 1 shows a conventional earphone and 3.5 mm audio plug. The audio plug 10 is provided for inserting into an audio jack 12 of a mobile phone 11 and has the main function of transmitting signals. The U.S. Pat. No. 7,912,501 B2 of Apple Inc. as shown in FIG. 1B discloses an audio I/O headset plug comprising a plug 400 having four signal conducting regions divided by a insulation ring 405 and the signal conducting regions are numbered 1 to 4 wherein the signal conducting regions 2 to 4 has external diameter of 3.5 mm. Each signal conducting region has different signal transmission purpose as shown in FIG. 2. For example, for a non-stereo headset, the signal conducting region 1 is used for a single speaker and the signal conducting regions 2 and 3 are for grounding GND, and the signal conducting region 4 is used for a microphone Mic. Moreover, for different headset system, the signal conducting region has different signal transmission function. For example, for a stereo headset, the signal conducting regions 1 and 2 are left and right channels; for a headphone, the signal conducting regions 3 and 4 are for grounding. Thus, the disclosed U.S. Pat. No. 7,912,501 B2 mainly provides a plug and a plug detection circuitry.

However, the disclosed audio plug 10, 400 is a solid structure with several metal rods and three insulating ring 405 and the main function thereof as shown in FIG. 1B is to obtain signals by respectively connecting the signal conducting regions 1 to 4 with first to fourth terminals 121~424 at a predetermined position in the audio jack 12. Thus, sounds including calls sound are transmitted through the signal conducting regions to the external headphone or microphone; therefore, the sounds will not be output from a speaker 13. That is, when the audio plug 10 is inserted into the audio jack of the headphone, only the incoming call sound can be heard; after pressing the answer key, the audio signal is transmitted to the headphone jack 12 not to the speaker 13. Furthermore, there is no internal space can be used so the audio jack 12 can only be used for obtaining audio signal. Therefore, there is room for improvement.

SUMMARY OF THE INVENTION

It is a primary object of the present invention to provide an audio plug structure improvement to form an ON/OFF switch of the audio plug without affecting the normal sound output of electronic products.

It is another object of the present invention to provide the audio plug coinciding with the standard specification of a 2.5 mm, 3.5 mm or 6.5 mm audio plug to connect with a terminal at a predetermined position in the corresponding audio jack and to provide a hollow tube for installing an electronic element such that the audio plug has other functions except for transmitting the audio signal.

In order to achieve the above objects, the audio plug structure improvement comprises a hollow tube made of conductive materials and having a first conductive portion at a front section thereof, a first insulating portion at a rear section thereof, a front end forming a first opening and a rear end forming a second opening and an entire outer diameter of the hollow tube remaining standard specification of a scheduled audio plug; a head made of insulation materials and having a front-end portion being a cone body coinciding with the specification audio plug and a cylindrical junction at a rear-end portion thereof for inserting into the first opening, the front-end portion projecting at a front of the hollow tube and having an axial gap at middle thereof for inserting a conductive plate body, at least a side surface of the head forming a second conductive portion and the rest of surfaces of the head forming a second insulating portion and the second conductive portion insulated against the first conductive portion of the hollow tube by the cylindrical junction; and an electronic element having a first electrode and a second electrode respectively coupled with the second conductive portion and the first conductive portion.

Whereby when the audio plug is inserted into an audio jack of a predetermined electronic product, the first conductive portion and the second conductive portion are respectively electronically connected to a second terminal and a first terminal arranged at a predetermined position in the audio jack for obtaining power and supplying the power or a signal required by the electronic element; simultaneously, the first insulating portion is connected to terminals other than the second terminal and the first terminal in the audio jack for avoiding a sound outputting from the audio jack; when the audio plug is rotated at an angle, the first conductive portion and the second conductive portion are departed from the second terminal and the first terminal for cutting off the electrical connection between the audio plug and audio jack.

Based on the features disclosed, the audio plug uses the composite structure of the conductive portion and insulating portion and the design of angle rotation to obtain power or signal without affecting normal use of the speaker of the electronic product. The ON/OFF switch is formed as long as the audio plug is rotated at a predetermined angle. Moreover, a predetermined electronic element can be arranged at the internal or external of the audio plug and the power or signal is obtained by the audio jack for having other functions except for transmitting the audio signal.

DETAILED DESCRIPTION OF THE PREFERRED EMBODIMENT

Figure 1A:
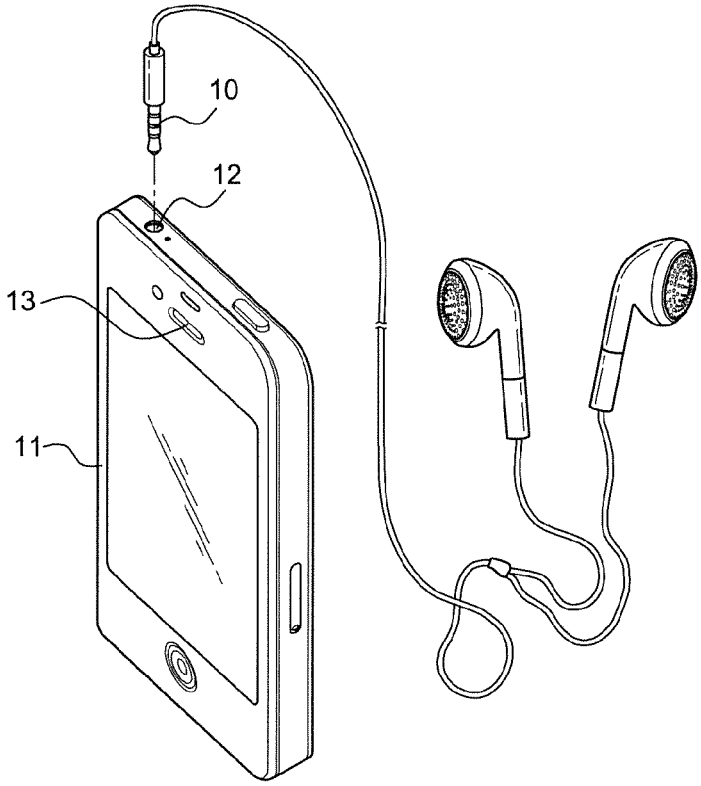
FIG.1A PRIOR ART
FIG. 1A is a schematic view of a conventional audio plug.
Figure 1B:
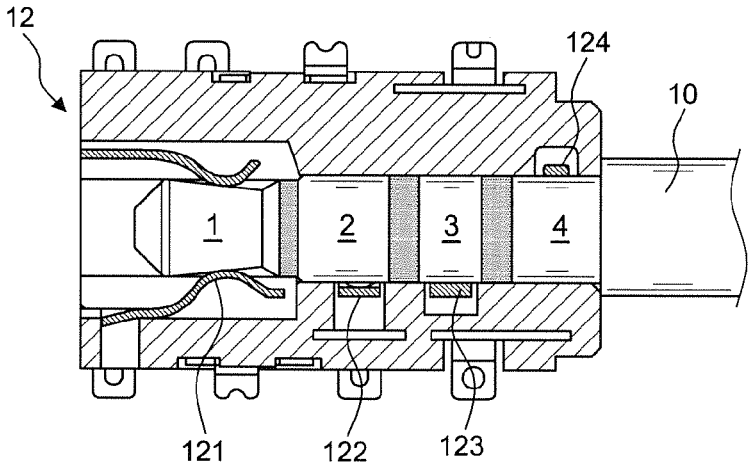
FIG.1B PRIOR ART
FIG. 1B is a sectional view illustrating the conventional audio plug inserted into a conventional audio jack.
Figure 2:
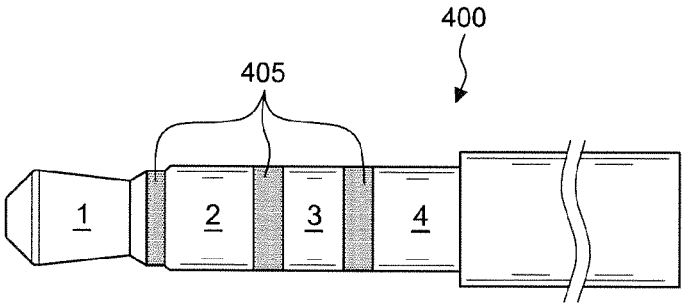
FIG.2 PRIOR ART
FIG. 2 discloses signal conducting regions of the plug of the U.S. Pat. No. 7,912,501 B2.

First, it is understandable for skilled person that some certain words in this description and the subsequent claims are referred to specific components. Second, the components in this description and the subsequent claims are not distinguished by different terms of the components but the different functions of the components. Third, the term "include" or "comprise" in this description and the subsequent claims is referred to an open term which should be interpreted as "including, but not limited to." Besides, the term "coupled with" includes direct and indirect means of electrical connection. Last, the audio plug in the present invention includes standard specification of a 2.5 mm, 3.5 mm or 6.5 mm audio plug. However, the following embodiment illustrates standard specification of a 3.5 mm audio plug.

Referring to FIGS. 3 through 7, the preferred embodiment of an audio plug structure improvement in accordance with the present invention comprises: a hollow tube 30, a head 40 and an electronic element 50.

The hollow tube 30 is made of conductive materials and has a first conductive portion 31 at a front section thereof, a first insulating portion 32 at a rear section thereof, a front end forming a first opening 33 and a rear end forming a second opening 34 and an entire outer diameter of the hollow tube 30 remains standard specification of a scheduled audio plug.

The head 40 is made of insulation materials and has a front-end portion 41 being a cone body coinciding with the standard specification of the scheduled audio plug and a cylindrical junction 42 at a rear-end portion thereof for inserting into the first opening 33. The front-end portion 41 is projecting at a front of the hollow tube 30 and has an axial gap at middle thereof for inserting a conductive plate body 44 for at least a side surface of the head 40 forming a second conductive portion 44*a*. In this embodiment, the second conductive portion 44*a* is formed at two corresponding side surfaces of the head 40. The rest of surfaces of the head 40 form a second insulating portion 44*b* and the second conductive portion 44*a* is insulated against the first conductive portion 31 of the hollow tube 30 by the cylindrical junction 42.

Figure 3:
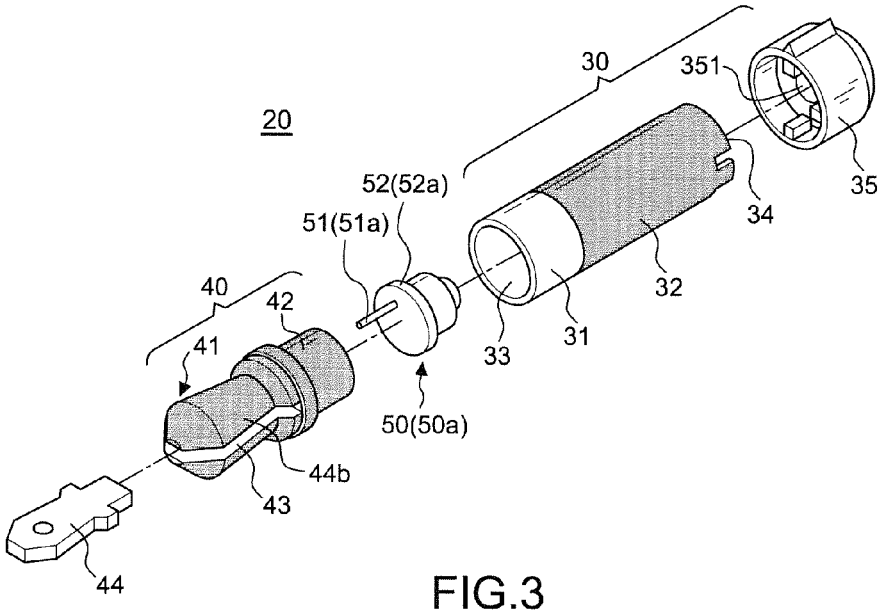
FIG. 3 is an exploded view of the preferred embodiment in accordance with the present invention.
Figure 3A:
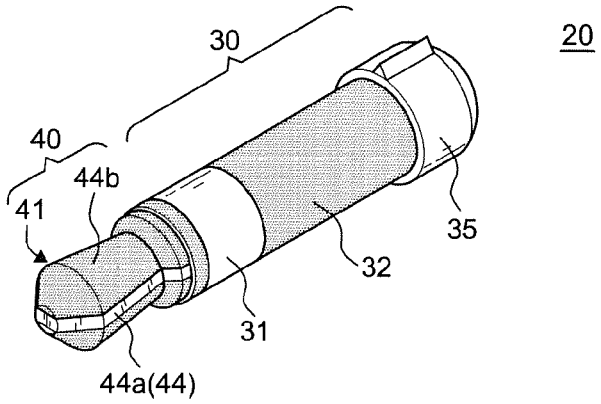
FIG. 3A is an assembled perspective view of FIG. 3.
Figure 6A:
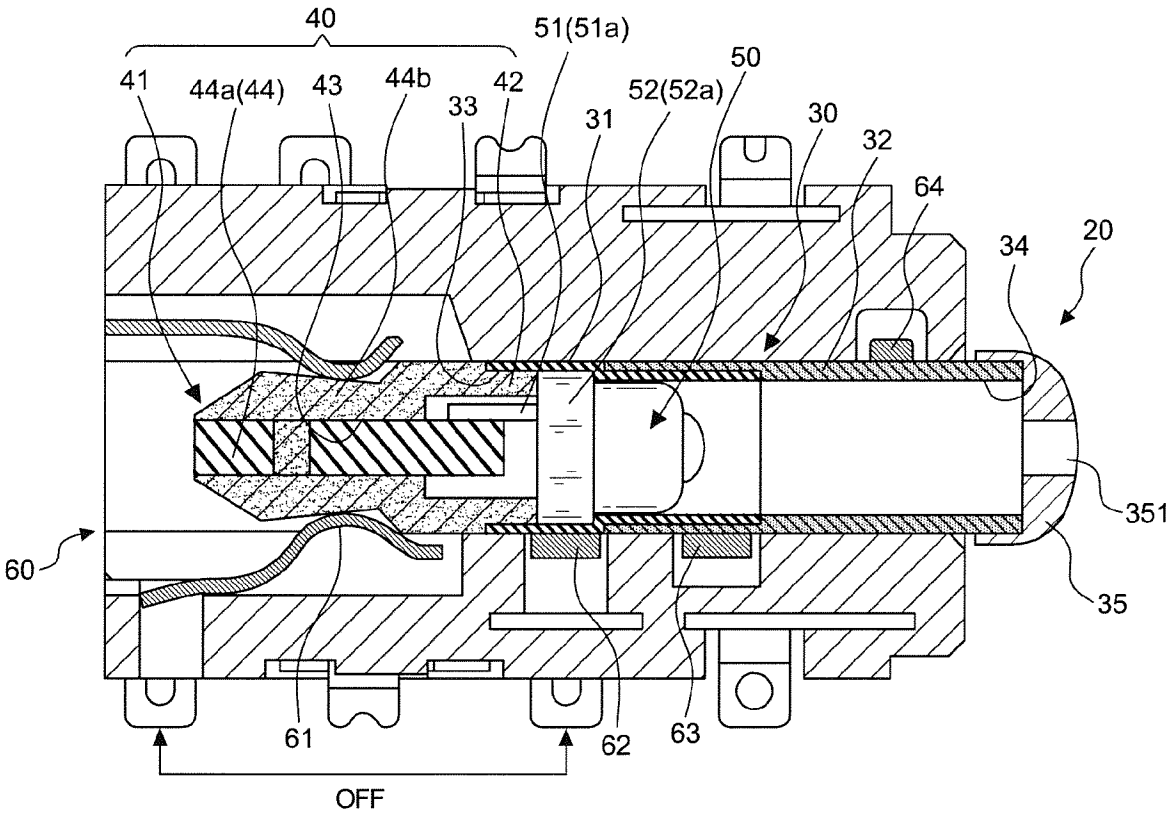
FIG. 6A is a cross-sectional view taken along the line 6A-6A in FIG. 5A.
Figure 6B:
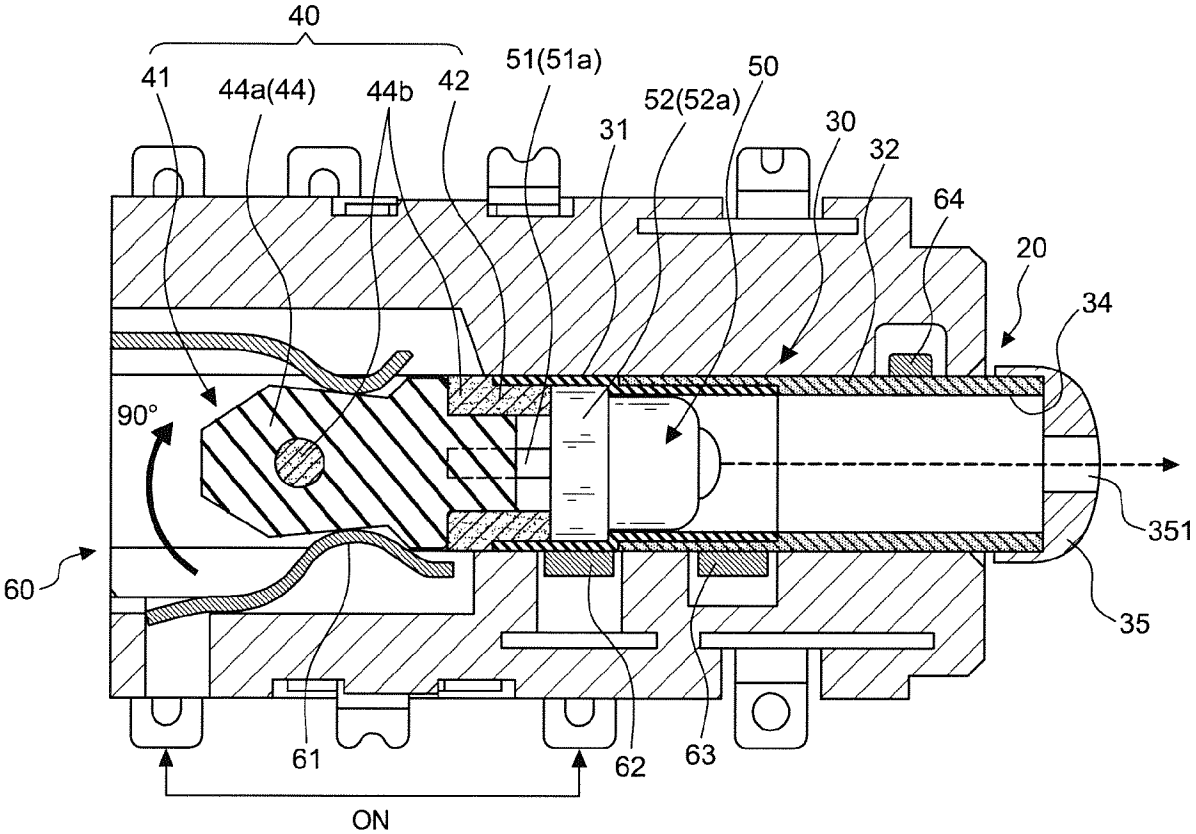
FIG. 6B is a cross-sectional view taken along the line 6B-6B in FIG. 5B.

The electronic element 50 has a first electrode 51 and a second electrode 52 respectively coupled with the second conductive portion 44*a* and the first conductive portion 31. In the embodiment, the electronic element 50 includes a light-emitting element 50*a*, a sounding element, an electromagnetic wave element or an optical element. FIGS. 3, 6A and 6B illustrate that the electronic element 50 is the light-emitting element 50*a* such as an LED or LD. In the embodiment, the light-emitting element 50, 50*a* is arranged in the hollow tube 30 and has a pin 51*a* and a base 52*a* as the first electrode 51 and the second electrode 52 respectively coupled with the second conductive portion 44*a* and the first conductive portion 31. The internal space of the hollow tube 30 may also set other electronic elements according to functional requirements and will not be described in details here.

Figure 5A:
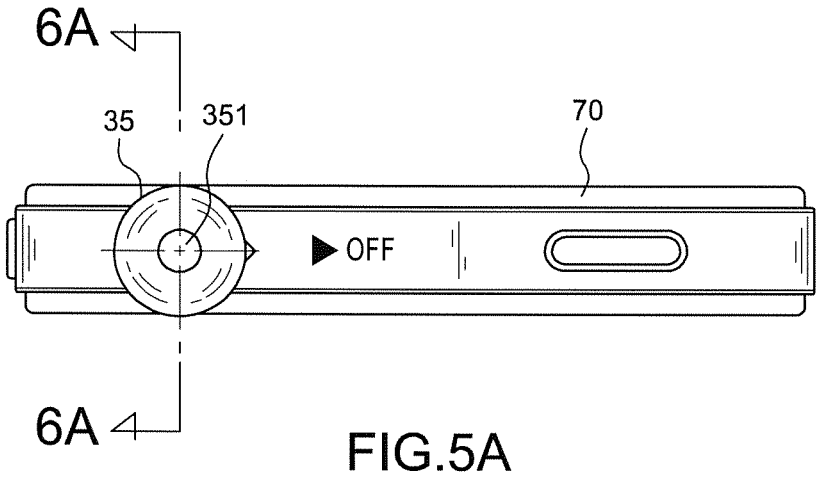
FIG. 5A is a top plan view of the present invention inserted into the audio jack, illustrating an OFF state.

With the references to FIGS. 5A and 6A, the audio plug 20 is in an OFF state when the audio plug 20 is inserted into the audio jack 60; that is, the first terminal 61 of the audio jack 60 is connected to a second insulating portion 44*b* of the audio plug 20 and a third and fourth terminal 63, 64 are connected to the first insulating portion 32. Thus, even though the audio plug 20 is inserted into the audio jack 60, the sound of an electronic product 70 such as a smartphone will not be output from the audio jack 60 but from the speaker 71, which does not affect the normal use of the smartphone 70.

Figure 5B:
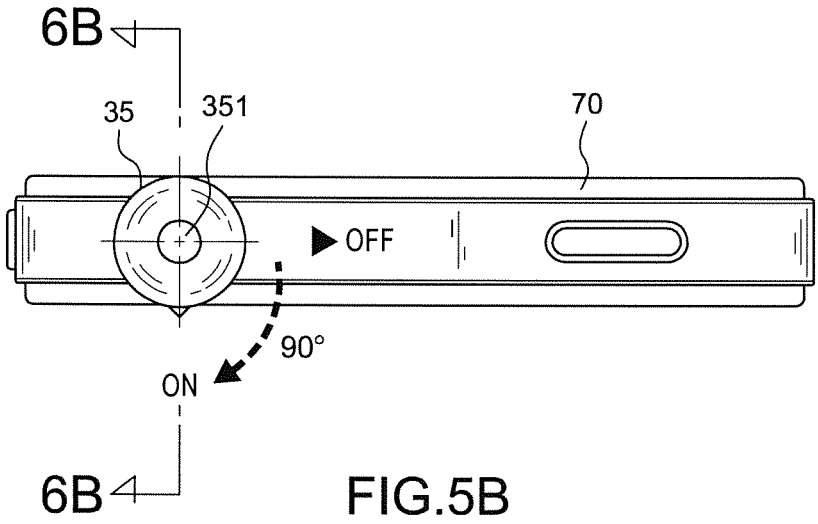
FIG. 5B is a top plan view of the present invention inserted into the audio jack, illustrating an ON state.
Figure 7:
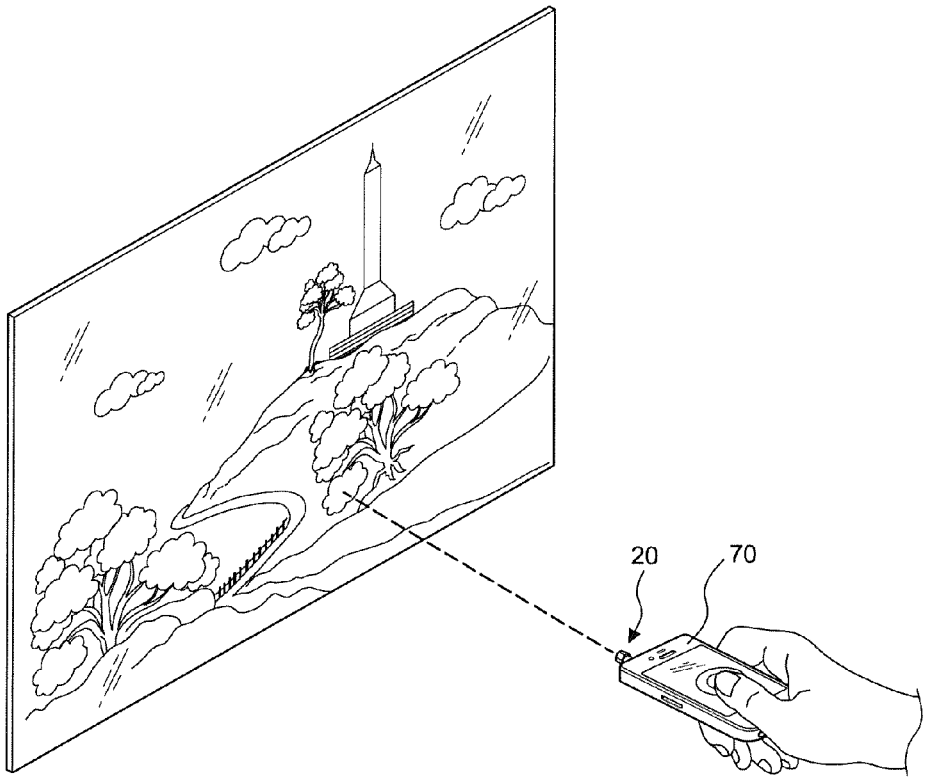
FIG. 7 is an application example of the present invention.

With the references to FIGS. 5B and 6B, the audio plug 50 is in an ON state when the audio plug 20 is rotated at an angle of 90°; that is, the first conductive portion 31 and the second conductive portion 44*a* are respectively electronically connected to the second terminal 62 and the first terminal 61. Thus, the light-emitting element 50*a* obtains power from the first electrode 51 and the second electrode 52 and emits light from a light-emitting hole 351 of the sealed cap 35 to form a laser pen or light-emitting pen as shown in FIG. 7 for making a presentation or teaching.

Whereby when the audio plug 20 is inserted into the audio jack 60 of a predetermined electronic product 70, the first conductive portion 31 and the second conductive portion 44*a* are respectively electronically connected to a second terminal 62 and a first terminal 61 arranged at a predetermined position in the audio jack 60 for obtaining power and supplying the power or signal required by the electronic element 50; simultaneously, the first insulating portion 32 is connected to terminals other than the second terminal 62 and the first terminal 61 in the audio jack 60 for avoiding the sound outputting from the audio jack 60; when the audio plug 20 is rotated at an angle, the first conductive portion 31 and the second conductive portion 44*a* are departed from the second terminal 62 and the first terminal 61 for cutting off the electrical connection between the audio plug 20 and audio jack 60.

Figure 3B:
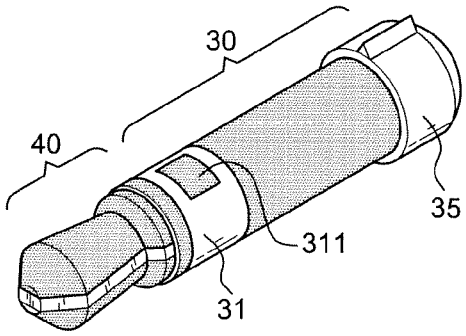
FIG. 3B is a schematic view of another embodiment, illustrating the structure of FIG. 3A.

With the reference to FIG. 3B, the first conductive portion 31 has a small area forming an insulation surface 311 at a surface thereof. The insulation surface 311 is designed for some of market mobile phone such as SAMSUNG mobile phones having the second terminal and circuit design (not shown) in the audio jack. When the audio plug 20 is rotated at an angle to form the OFF state, not only the first terminal 61 is connected to the second insulating portion 44*b* but the second terminal 62 is connected to the insulation surface 311 to form the non-conductive loop. Thus, when answering an incoming call, the audio signal is not transmitted to the headphone jack but to the speaker 71. However, the insulation surface 311 is optional.

Consequently, the present invention discloses the audio plug 20 matching the existing 3.5 mm audio jack 60 of the electronic products to hide the LD or LED in the headphone jack.

Figure 3C:
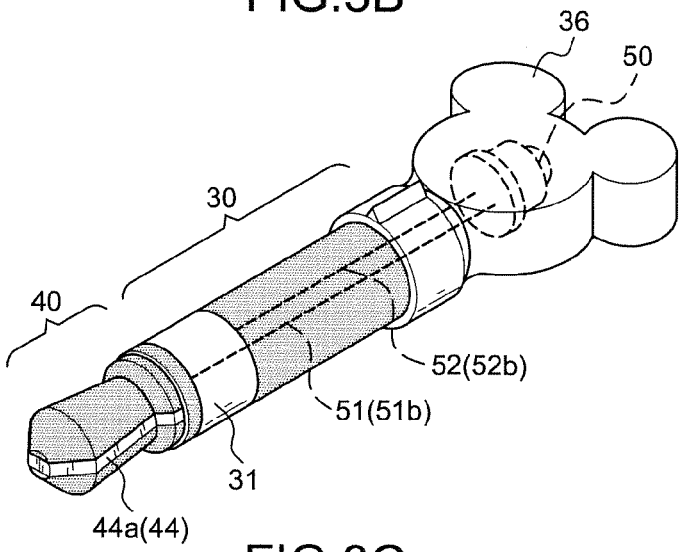
FIG. 3C is a schematic view of another embodiment in accordance with the present invention.
Figure 4:
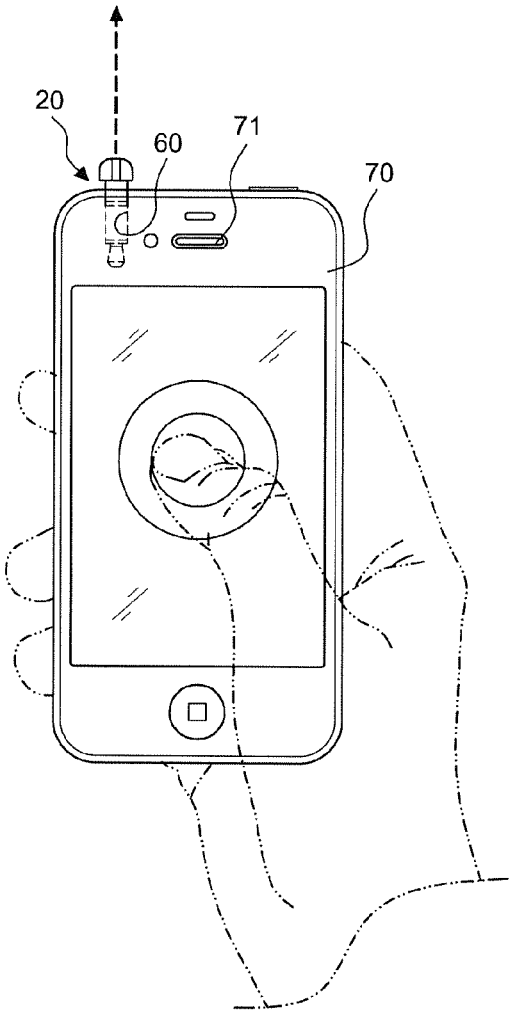
FIG. 4 is a front elevational view, illustrating the present invention inserted into the audio jack.
Figure 4A:
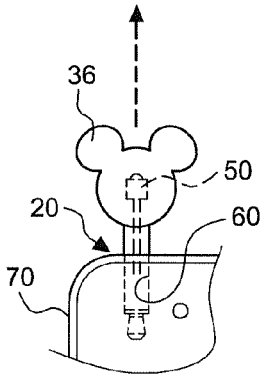
FIG. 4A is a schematic view of the present invention, illustrating an electronic element arranged outside of the audio plug.
Figure 4B:
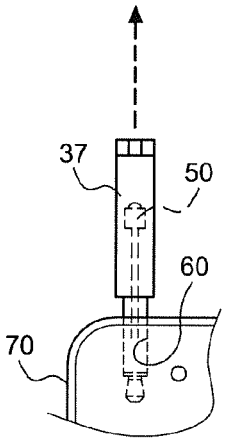
FIG. 4B is schematic view of the present invention, illustrating the electronic element arranged inside of the audio plug.
Figure 6C:
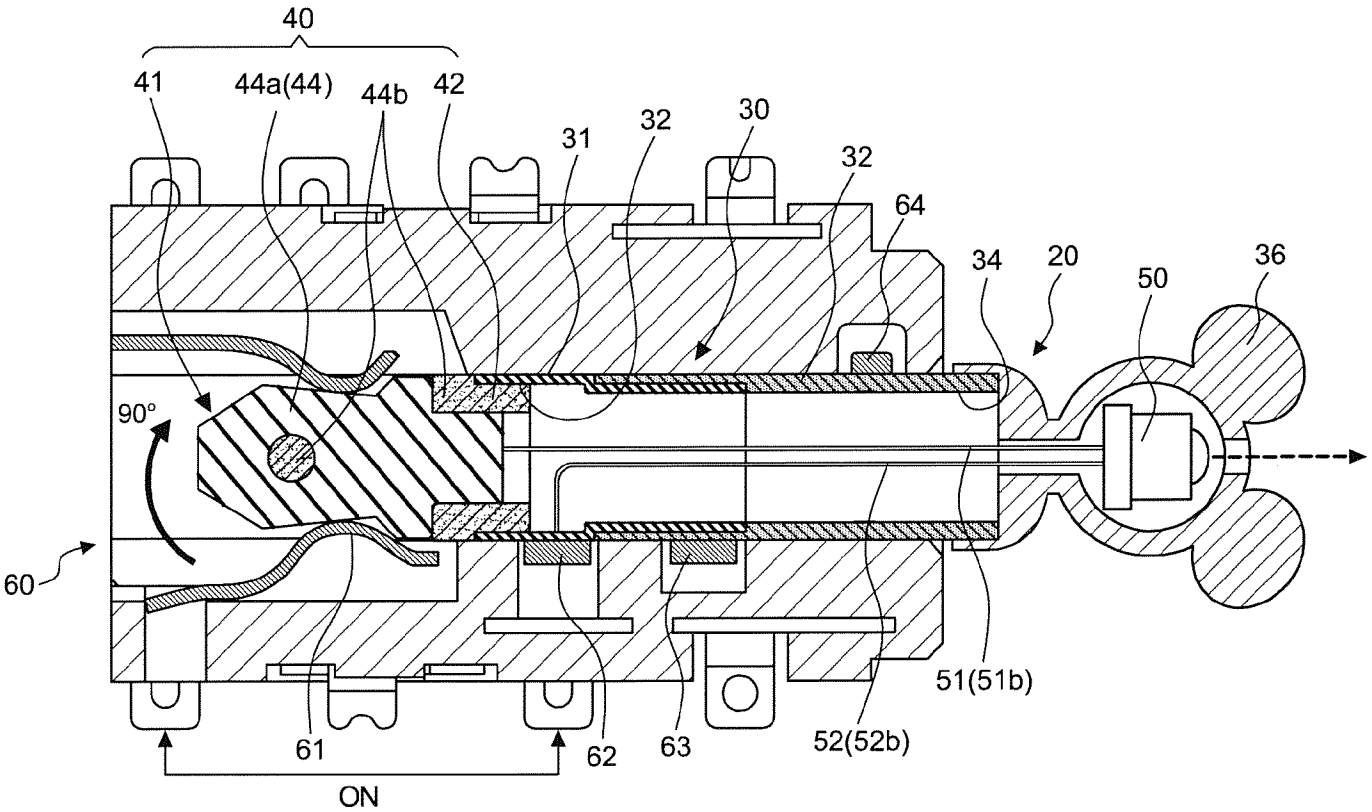
FIG. 6C is an sectional view, illustrating the electronic element arranged outside of the audio plug.

FIGS. 3C and 6C illustrate another embodiment of the present invention. The electronic element 50 is arranged at an outside of the hollow tube 30 and having two lead wires as the first electrode 51 and the second electrode 52 respectively coupled with the second conductive portion 44*a* and the first conductive portion 31. The above-mentioned embodiment uses the same means to rotate the audio plug 20 so that the electronic element 50 can obtain power from the audio jack 60 or cut off the power. With the references to FIGS. 4A and 6C, the second opening 34 of the hollow tube 30 may include a modeling sealed cap 36 as shown in FIG. 6C or a long sealed cap 37 as shown in FIG. 4B and the electronic element 50 is arranged inside the modeling sealed cap 36 or long sealed cap 37 and the electronic element 50 may be arranged inside the hollow tube 30.

Based on the features disclosed, the audio plug 20 uses the composite structure of the conductive portion and insulating portion and the design of angle rotation to obtain power or signal without affecting normal use of the speaker of the electronic product. The ON/OFF switch is formed as long as the audio plug is rotated at a predetermined angle. Moreover, a predetermined electronic element can be arranged at the internal or external of the audio plug and the power or signal is obtained by the audio jack for having other functions except for transmitting the audio signal.

What is claimed is:

1. An audio plug structure improvement, comprising:

a hollow tube made of conductive materials and having a first conductive portion at a front section thereof, a first insulating portion at a rear section thereof, a front end forming a first opening and a rear end forming a second opening and an entire outer diameter of the hollow tube remaining standard specification of a scheduled audio plug;

a head made of insulation materials and having a front-end portion being a cone body coinciding with the specification audio plug and a cylindrical junction at a rear-end portion thereof for inserting into the first opening, the front-end portion projecting at a front of the hollow tube and having an axial gap at middle thereof for inserting a conductive plate body, at least a side surface of the head forming a second conductive portion and the rest of surfaces of the head forming a second insulating portion and the second conductive portion insulated against the first conductive portion of the hollow tube by the cylindrical junction; and an electronic element having a first electrode and a second electrode respectively coupled with the second conductive portion and the first conductive portion;

whereby when the audio plug is inserted into an audio jack of a predetermined electronic product, the first conductive portion and the second conductive portion are respectively electronically connected to a second terminal and a first terminal arranged at a predetermined position in the audio jack for obtaining power and supplying the power or a signal required by the electronic element; simultaneously, the first insulating portion is connected to terminals other than the second terminal and the first terminal in the audio jack for avoiding a sound outputting from the audio jack; when the audio plug is rotated at an angle, the first conductive portion and the second conductive portion are departed from the second terminal and the first terminal for cutting off the electrical connection between the audio plug and audio jack.

2. The audio plug structure improvement as claimed in claim 1, wherein the first conductive portion has a small area forming an insulation surface at a surface thereof.

3. The audio plug structure improvement as claimed in claim 1, wherein the insulation materials the head includes plastic or rubber.

4. The audio plug structure improvement as claimed in claim 1, wherein the electronic element includes a light-emitting element, a sounding element, electromagnetic wave element or an optical element.

5. The audio plug structure improvement as claimed in claim 4, wherein the light-emitting element is arranged in the hollow tube and has a pin and a base as the first electrode and the second electrode respectively coupled with the second conductive portion and the first conductive portion and the second opening includes a sealed cap.

6. The audio plug structure improvement as claimed in claim 4, wherein the electronic element is arranged at an outside of the hollow tube and has two lead wires as the first electrode and the second electrode respectively coupled with the first conductive portion and the second conductive portion and the second opening includes a modeling sealed cap or a long sealed cap and the electronic element is arranged inside the modeling sealed cap or long sealed cap.

* * * * *